US006210241B1

(12) United States Patent
Michaelis

(10) Patent No.: US 6,210,241 B1
(45) Date of Patent: Apr. 3, 2001

(54) ELECTRICAL CONTACTING OF FINE WIRE

(75) Inventor: Andre Michaelis, Wedemark (DE)

(73) Assignee: Sennheiser Electronic GmbH & CO KG, Wedemark (DE)

( * ) Notice: Subject to any disclaimer, the term of this patent is extended or adjusted under 35 U.S.C. 154(b) by 0 days.

(21) Appl. No.: 09/105,772

(22) Filed: Jun. 26, 1998

(30) Foreign Application Priority Data

Jul. 2, 1997 (DE) ..... 197 27 973

(51) Int. Cl.[7] ..... H01R 11/22
(52) U.S. Cl. ..... 439/857
(58) Field of Search ..... 439/856, 857, 439/875, 786, 787, 708; 174/74 R, 846; 156/49

(56) References Cited

U.S. PATENT DOCUMENTS

| | | | | |
|---|---|---|---|---|
| 2,601,276 | | 6/1952 | Gordon . | |
| 3,355,698 | | 11/1967 | Keller . | |
| 3,728,473 | * | 4/1973 | Kuo | 174/84 C |
| 3,736,627 | | 6/1973 | Sosinski . | |
| 3,752,901 | * | 8/1973 | Kuo | 174/84 C |
| 3,897,992 | * | 8/1975 | Weidler | 439/442 |
| 4,551,579 | * | 11/1985 | Takasaki | 174/88 R |
| 4,877,936 | | 10/1989 | Kobayashi . | |
| 5,541,365 | * | 7/1996 | Sugiura et al. | 174/94 R |
| 5,583,944 | | 12/1996 | Morohoshi et al. . | |

FOREIGN PATENT DOCUMENTS

| | | |
|---|---|---|
| 30 49 737 | 2/1982 | (DE) . |
| 42 43 308 | 6/1994 | (DE) . |
| 0 378 337 A2 | 7/1990 | (EP) . |

* cited by examiner

*Primary Examiner*—Khiem Nguyen
*Assistant Examiner*—J. F. Duverne
(74) *Attorney, Agent, or Firm*—Merchant & Gould P.C.

(57) ABSTRACT

Electrical contacting of very fine wires, including an electrical transducer and an electrical apparatus, as well as a process for producing the electrical contacting of very fine wires.

It is the goal of the invention to simplify the electrical contacting of very fine wires to the contact sleeve and make it more secure, so that an automatic is possible and the production costs for the electrical contacting are reduced. According to the invention, for the accomplishing of the set task an electrical contacting of a very fine wire is proposed, in which contacting the contact sleeve shows two superimposed plates and provision is made for a clamp region of the plates, in which region the plate spacing is less than in the other plate regions. In the clamp region the wire is clamped in between the plates and connected to at least one of the plates in an electrically conducting manner. Advantageous further developments are described in the dependent claims.

6 Claims, 4 Drawing Sheets

ELECTRICAL CONTACTING OF FINE WIRE

TECHNICAL FIELD

Electrical contacting apparatus for contacting electrical apparatus and a process for production of the electrical contacting of the fine wire.

BACKGROUND

The contacting of very fine wires, such as find application in, for example, the electroacoustic transducers of headphones or microphones, is frequently very problematic and labor-intensive, because the wire gauges of the wires to the electroacoustic transducer, e.g. to the electrodynamic transducer, are frequently smaller than 100 $\mu$m and, moreover, the wire material used is often aluminum, which at such wire gauges cannot always be reliably and easily connected to a contact sleeve.

Hitherto, as revealed, for example, in WO 81/00328, for the electrical contacting of very fine wires to a contact sleeve, a wedge has been introduced into the contact region between the wire and a tube-shaped contact sleeve in such a manner that the wire is jammed in the contact sleeve and an electrical contact exists. However, the electrical contacting until now of very fine wires has been very labor-intensive, because up to now an automating has been practically impossible and thus the production of the contact had to be carried out manually.

For an understanding of which lead-in wires of an electroacoustic transducer must be connected to the contact sleeve, reference is made to DE A 42 43 308, in which an electroacoustic transducer is revealed, in particular for headphones, with a membrane carrying the moving coil of the transducer and with two lead-in wires leading up to the moving coil via the membrane. These lead-in wires lead on one hand to the membrane and on the other hand must be connected to a contact sleeve.

It is the goal of the invention to simplify the electrical contacting of very fine wires to the contact sleeve and make it more secure, so that an automation is possible and the production costs for the electrical contacting are reduced.

SUMMARY

According to the invention, for the accomplishing of the set task an electrical contacting of a very fine wire is proposed, in which contacting the contact sleeve shows two oppositely-lying plates and provision is made for a clamp region of the plates, in which region the plate spacing is less than in the other plate regions. In the clamp region the wire is clamped in between the plates and connected to at least one of the plates in an electrically conducting manner. Advantageous further developments are described in the dependent claims.

In addition, an electroacoustic transducer with a contacting possessing the above features is described, as well as an electrical apparatus with such an electroacoustic transducer and a process for production of the electrical contacting of the very fine wire.

It has been discovered that by means of the clamping of the wire to be contacted between the plates, a very simple and reliable contact connection can be produced. Production of the contacting according to the invention requires only the positioning of the wire to be contacted between the plates; the plates are then pressed against each other in the clamp region through application of an external force and the wire is thereby clamped in between the plates in the clamp region.

It was also found that through the contacting according to the invention or through the process according to the invention for producing this contacting, a connection is produced that is sufficiently solid mechanically and is electrically very well-conducting. Also, through the contacting according the invention the wire is automatically protected in the clamp region, since the opposite-lying plates of the contact sleeve cover the wire in the clamp region.

The contacting is stabilized if the plates are joined in the clamp region, e.g. through application of a spot weld from outside. Through such a weld, possible insulating or baked enamel on the wire in the clamp region is automatically more effectively displaced laterally than through the clamping itself, and the displaced enamel then seals the contact region.

Through the clamping of the wire in the clamp region, the wire is deformed by the clamping force, so that a spreading out of the wire in the clamp region occurs. By this means the surface of the wire, and thus the contact surface with the plates, is enlarged.

Further advantageous developments of the invention are described in the dependent claims.

BRIEF DESCRIPTION OF THE SEVERAL VIEWS OF THE DRAWINGS

In the following, the invention is explained in greater detail with the aid of an Implementation example represented in the drawings. The drawings show.

DETAILED DESCRIPTION OF THE ILLUSTRATED EMBODIMENTS

Figure 1:
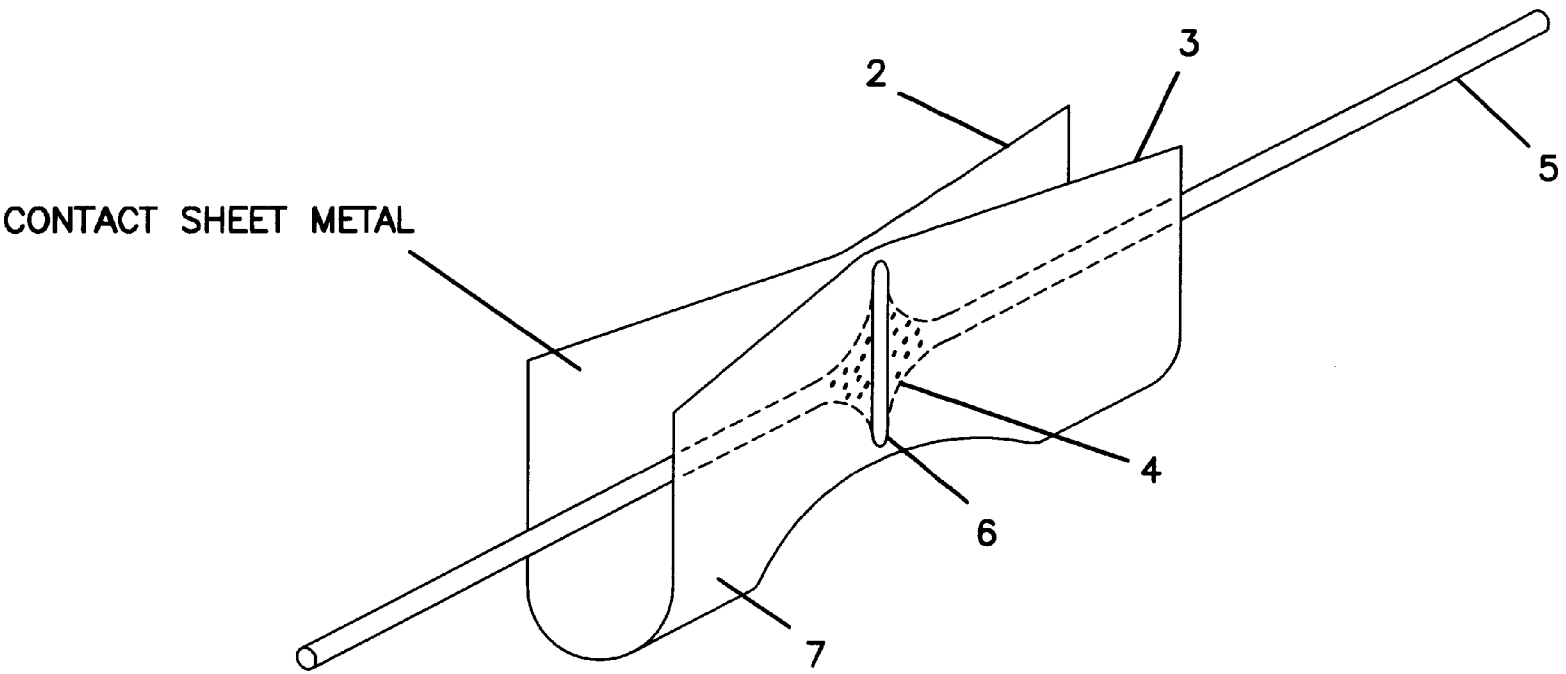
FIG. 1 a view in perspective of a contacting of a wire and a contact sleeve according to the invention

FIG. 1 shows a view in perspective of a contact sleeve, which is formed as a U-shaped contact metal sheet 1 with two essentially opposite-lying plate side pieces 2 and 3. Through clamping from outside, in the middle region 4 of the two opposite-lying plates 2 and 3 the plates are arranged with less distance between them than in the plate regions outside the clamped region. Inside the contact sleeve, between the opposite-lying plates a very fine wire 5 is arranged in the longitudinal direction of the contact sleeve and in the clamp region 4 is clamped in between the plates 2 and 3 of the contact sleeve.

In the clamp region 4 the very fine wire 5 undergoes a deformation, chiefly a spreading out, so that the very fine wire shows a larger outer surface in the clamp region than outside the clamp region. Beyond that, through the clamping in of the very fine wire in the clamp region, baked and/or insulating enamel, which surrounds the wire at the edge region of the metal-sheet wire contact, is pressed, so that the metal-sheet wire contact is protected externally by the insulating and/or baked enamel.

For fixing the metal-sheet plates, these are joined in the clamp region, be it through cementing or through welding, e.g. spot welding from outside. FIG. 1 shows an elongated weld 6, which runs essentially perpendicular to the wire 5.

Figure 2:
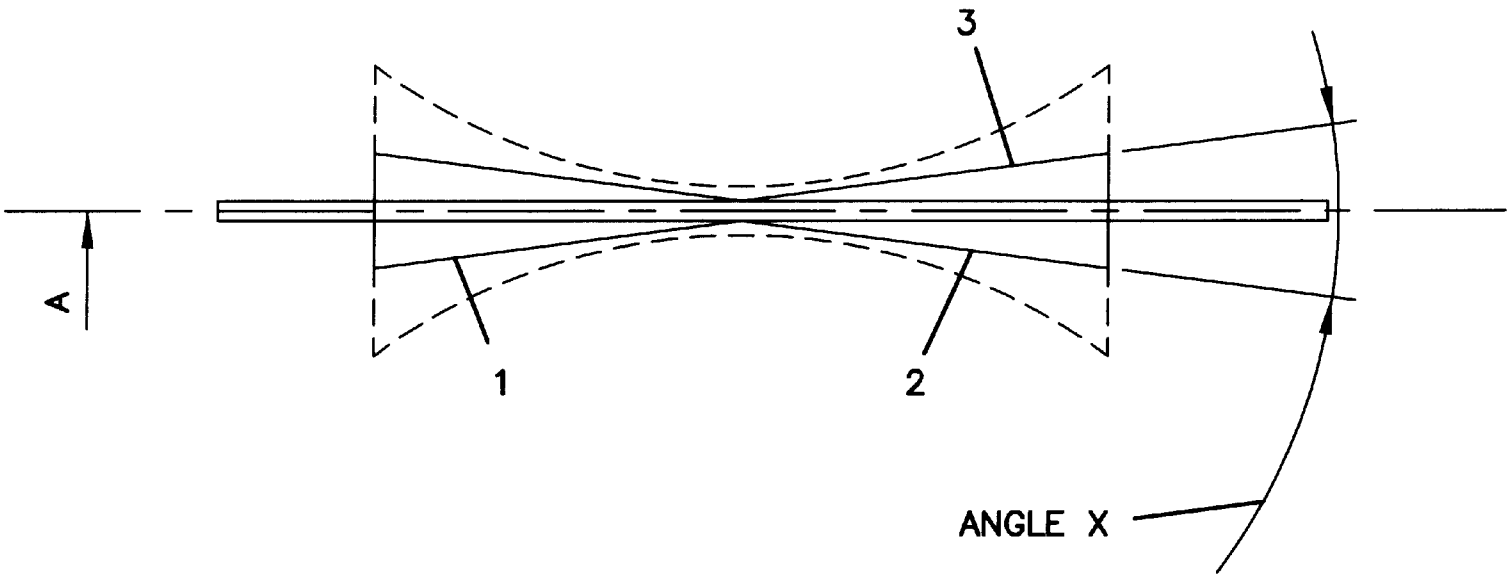
FIG. 2: a view from above of the contacting according to FIG. 1

FIG. 2 shows in plan view the contact metal sheet 1. Here it is easily perceived that through the clamping of the opposite-lying plates 2 and 3 the space between the plates is distinctly less in the clamp region 4 than in the regions outside the clamp region. The plate regions outside the clamp region also protect the wire, so that even when the wire is arranged in a manner deviating from the shown longitudinal wire direction, no tearing off of the wire due to a kink point is to be feared. The spread-out angle between the opposite-lying plates should lie between approximately 1° and 30°; however, a greater radius is also conceivable, as is indicated by the dashed line in FIG. 2. With a sufficiently small angle, in some cases the force that is necessary to pull the wire out of the contact metal sheet can be greater than the tensile strength of the wire itself.

Figure 3:
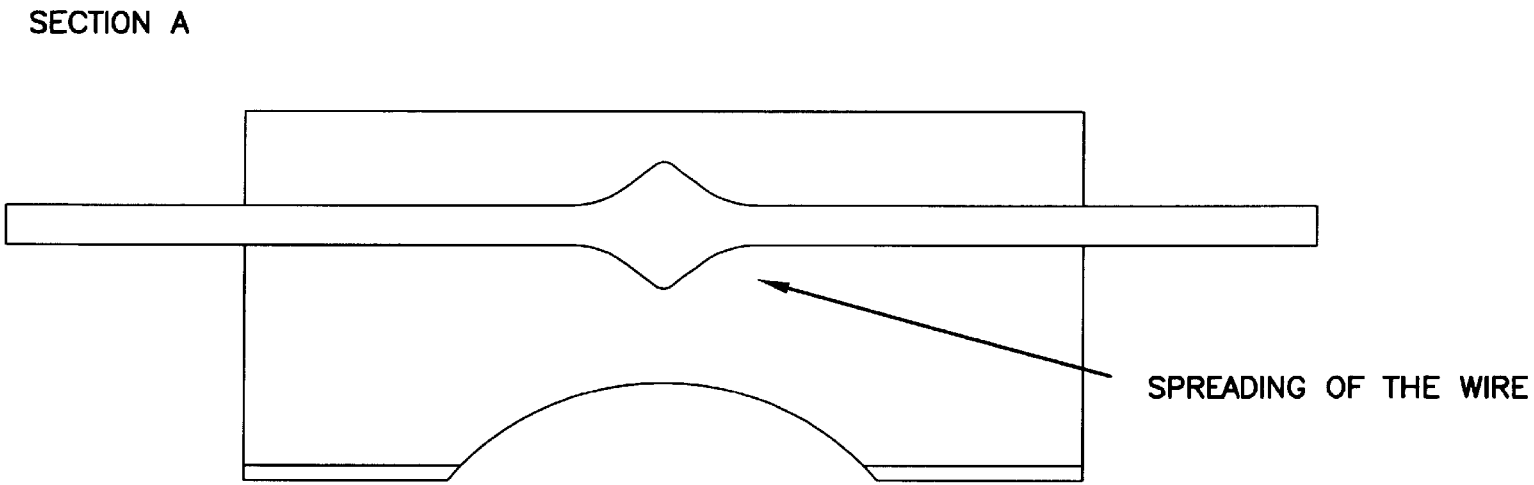
FIG. 3: a section according to the plane A—A in FIG. 3

FIG. 3 shows a section along the line A—A in FIG. 2. Here the spreading out of the wire in the clamp region is perceivable to an especially great degree. Through the spreading out of the wire, the contact surface between wire and metal sheet is augmented, so that undesired transition resistances cannot arise at all.

In the producing of the contact between a wire and contact sleeve, first of all the wire to be contacted is positioned between the opposite-lying plates. Then an appropriate clamping force is applied from outside to the plates in the clamp region, whereby the plate spacing in the clamp region is lessened to such a degree that the wire is clamped in between the two plates. With this the contacting is already produced. For a better fixing of the plates against each other, they can still be welded together, cemented together, or clamped together with appropriate clamping means.

By means of the described contacting, a satisfactory electrical connection of a wire with a nominal diameter of approximately 100 $\mu$m or smaller, e.g. 40 $\mu$m, to the contact sleeve could be obtained. All of the operational steps could be carried out by machine, which is very helpful with the exceedingly small dimensions of the individual components of the wire-and contact-sleeve.

Figure 4A:
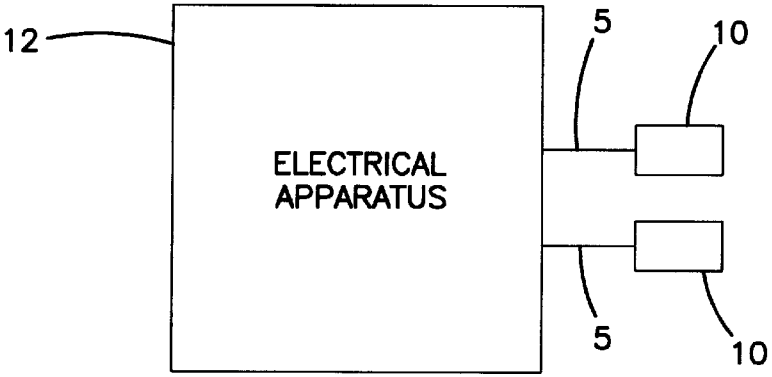
FIGS. 4A–C: embodiments including a contacting of a wire and a contact sleeve according to the invention.
Figure 4B:
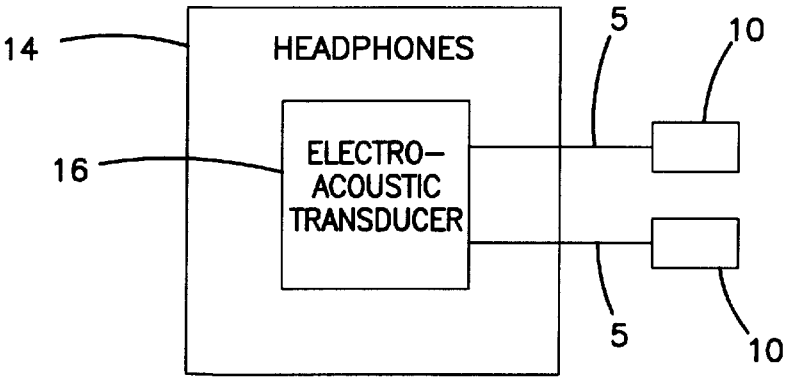
Figure 4C:
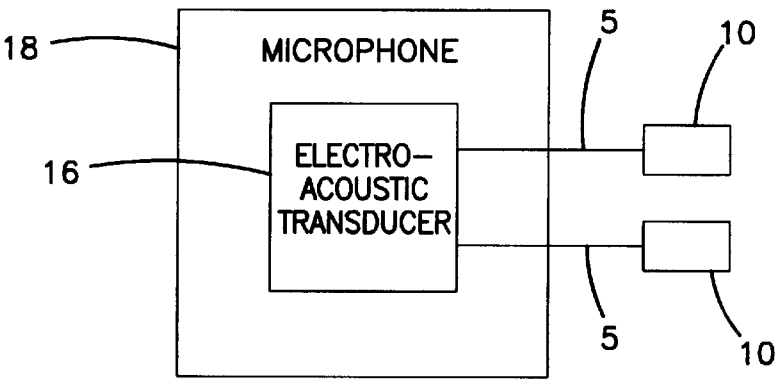

As wire material, any conventional wire material, especially aluminum or CuSn, can be used. As contact material, a CuSn material can likewise be used, which material is provided with a nickel, silver, or gold layer. FIG. 4A illustrates an electrical apparatus 12 including fine wires 5 in electrical contact with contact sleeve 10 according to the present invention. FIG. 4B illustrates headphones 14 including an electroacoustic transducer 16. The fine wires 5 are electrically connected at one end to the electroacoustic transducer 16 and at the other end to the contact sleeve 10 according to the present invention. FIG. 4C illustrates a microphone 18 including an electroacoustic transducer 16. The fine wires 5 are connected at one end to the electroacoustic transducer 16 and at the other end to the contact sleeve 10 according to the present invention.

What is claimed is:

1. An electroacoustic transducer comprising:

a wire having a surface area and a diameter of about 100 micrometers or less; and an electrical contacting, wherein the, electrical contacting of a wire includes:

a contact metal sheet with two opposite-lying plates separated by a distance; and a clamp region of the plates, in which the distance between the plates is less than in the other plate regions;

wherein the wire is positioned in the clamp region, is clamped between the plates, is in electrical contact with at least one plate, and is deformed so that the surface area of the wire is larger after the wire is clamped than before the wire is clamped.

2. A process for producing all electrical contact of a fine wire having a surface area, the electrical contact including a contact metal sheet with two opposite-lying plates, the two opposite lying plates separated by a distance, the two opposite lying plates having a first and second regions, the first region forming a clamp region, the distance between the plates in the first region is less than in the second region; wherein the wire is positioned in the clamp region, is clamped between the plates, and is in electrical contact with at least one plate, the process comprising:

(a) positioning a wire to be contacted between the opposite-lying plates;

(b) from outside the region in which an electrical contact between the wire and at least one of the plates is to be produced, clamping the plates; wherein the space between the plates is lessened to such an extent that the wire is clamped in between the two plates and is deformed so that the surface area of the wire is increased.

3. A process according to claim 2, wherein the plates are joined in the clamp region.

4. An electrical apparatus, comprising:

a electroacoustic transducer having a wire having a surface area and first and second ends, the first end of the wire being connected to the electroacoustic transducer; and an electrical contacting of the second end of the wire;

wherein the electrical contacting includes a contact metal sheet with two opposite-lying plates separated by a distance and having first and second regions, the first region forming a clamp region, the distance between the plates in fit-st region being less than the distance between the plates in the second region;

wherein, in the clamp region the wire is clamped in between the plates, is in electrical contact with at least one plate, and portion of the wire clamped between the two opposite-lying plates has a surface area that is larger after the wire is clamed than before the wire is clamped.

5. An electrical apparatus according to claim 4, wherein the electrical apparatus is headphones.

6. An electrical apparatus according to claim 4, wherein the electrical apparatus is a microphone.

* * * * *